US005354112A

United States Patent [19]

Hara et al.

[11] Patent Number: 5,354,112

[45] Date of Patent: Oct. 11, 1994

[54] GUIDE DEVICE FOR SIFTING AND TRANSPORTING CONTAINERS

[75] Inventors: Shinji Hara; Kiyoshi Fujiwara; Toru Takehara; Masaharu Kawaguchi; Masayasu Miyake, all of Tamano, Japan

[73] Assignee: Mitsui Engineering & Shipbuilding Co., Ltd., Tokyo, Japan

[21] Appl. No.: 987,841

[22] Filed: Dec. 9, 1992

[30] Foreign Application Priority Data

| | | | |
|---|---|---|---|
| Dec. 9, 1991 | [JP] | Japan | 3-101080[U] |
| Dec. 10, 1991 | [JP] | Japan | 3-101522[U] |
| Jun. 11, 1992 | [JP] | Japan | 4-152096 |
| Oct. 2, 1992 | [JP] | Japan | 4-068945[U] |
| Oct. 23, 1992 | [JP] | Japan | 4-290322 |

[51] Int. Cl.[5] ..... B66C 1/66

[52] U.S. Cl. ..... 294/81.41; 294/81.2; 294/81.5

[58] Field of Search ..... 294/68.3, 81.1–81.21, 294/81.4, 81.41, 81.5–81.54; 212/128; 414/392, 460, 461, 607, 608

[56] References Cited

U.S. PATENT DOCUMENTS

| | | | |
|---|---|---|---|
| Re. 27,905 | 1/1974 | Whiteman | 294/81.2 X |
| 3,078,115 | 2/1963 | Harlander et al. | 294/81.41 X |
| 3,151,904 | 10/1964 | Tantlinger et al. | 294/81.41 |
| 3,243,224 | 3/1966 | Gutridge | 294/81.54 X |
| 3,453,017 | 7/1969 | Nagy | 294/81.41 |
| 3,752,346 | 8/1973 | Thompson et al. | 294/81.21 X |
| 3,880,456 | 4/1975 | DeRoshia | 294/81.2 |
| 4,139,107 | 2/1979 | Ninomiya et al. | 294/81.4 X |
| 4,172,685 | 10/1979 | Nabeshima et al. | 294/81.41 X |
| 4,179,149 | 12/1979 | Brochard | 294/81.41 |

FOREIGN PATENT DOCUMENTS

| | | | |
|---|---|---|---|
| 3621648 | 1/1988 | Fed. Rep. of Germany | 294/81.53 |
| 2659637 | 9/1991 | France | 294/81.41 |
| 120195 | 5/1991 | Japan | 294/81.53 |
| 368171 | 1/1973 | U.S.S.R. | 294/81.53 |

*Primary Examiner*—Johnny D. Cherry
*Attorney, Agent, or Firm*—Nikaido, Marmelstein, Murray & Oram

[57] ABSTRACT

The guide device for craning a container has guides so arranged that they can be moved vertically by a raising/lowering device mounted on the spreader body and can be positioned at the corners of the spreader. The guides are lowered by the raising/lowering device and secured to the bottom corners of the container held by the spreader. Then the spreaded parts of the guides project from the lower end of the container to secure the spreader to the container. The structure of the spreader is simple and the weight is light.

11 Claims, 16 Drawing Sheets

Fig.7 ( a )
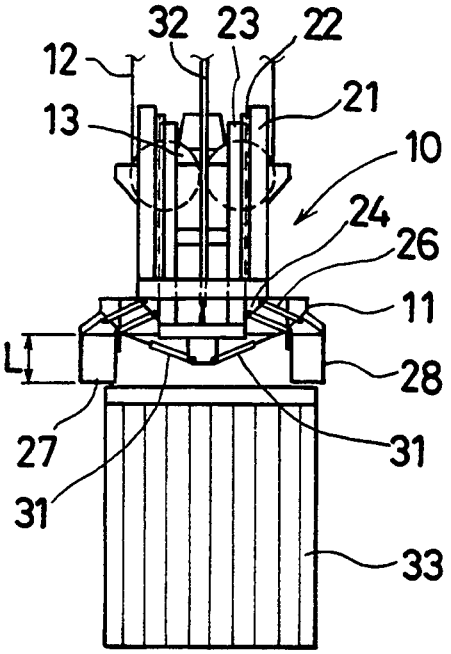
Fig.7 ( b )
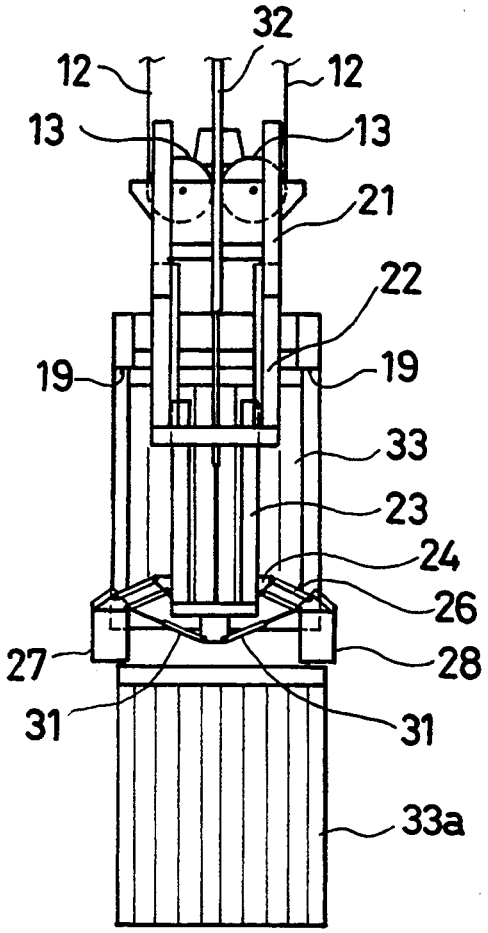

Fig.12
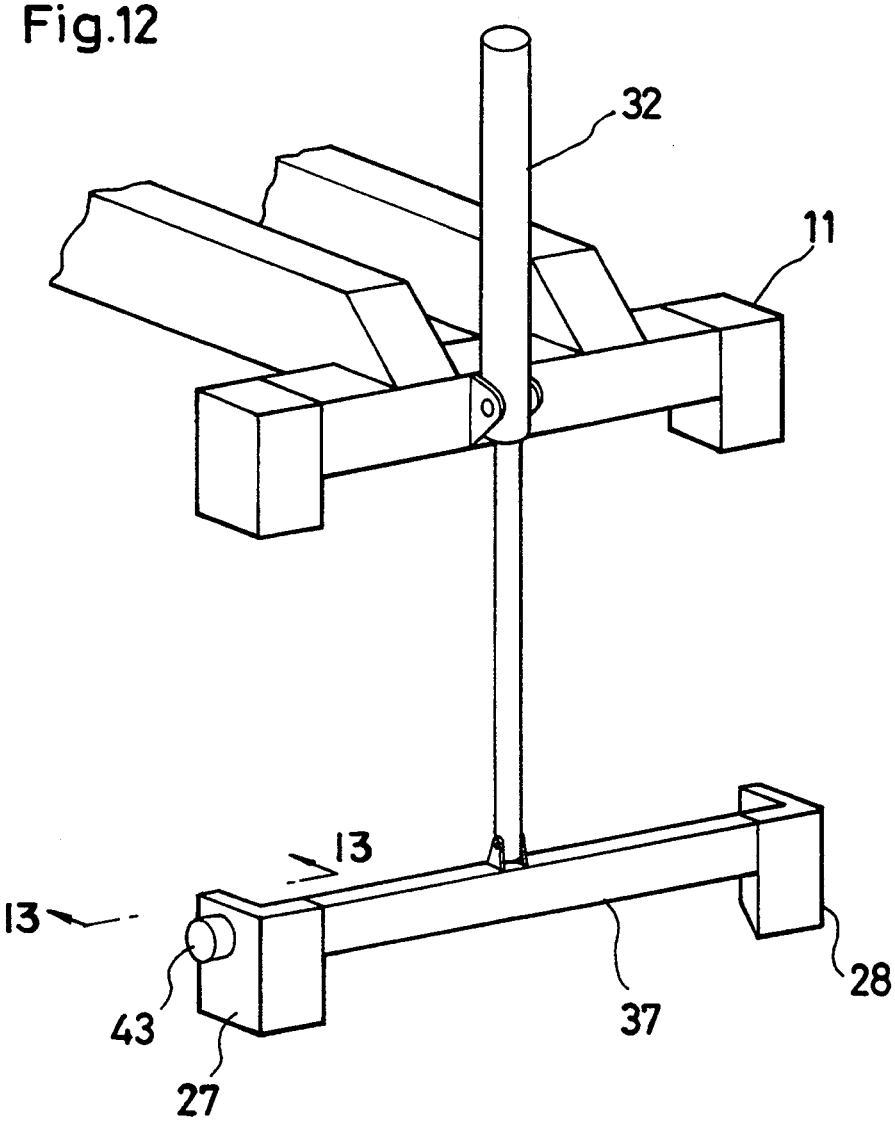
Fig.13 ( a )
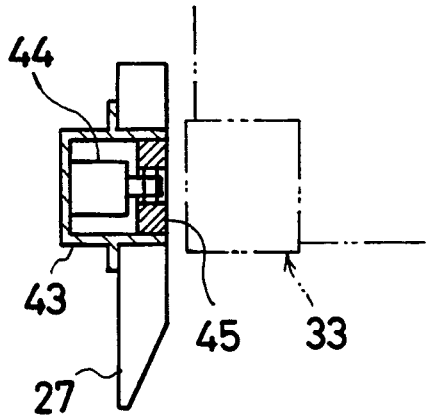
Fig.13 ( b )
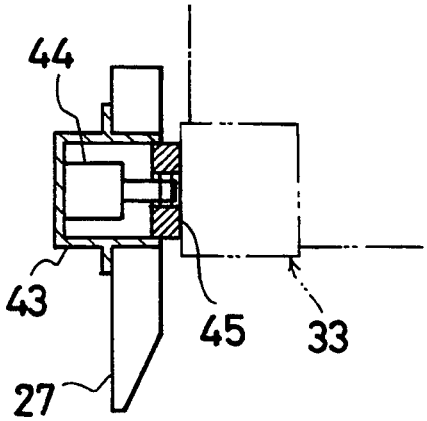

GUIDE DEVICE FOR SIFTING AND TRANSPORTING CONTAINERS

BACKGROUND OF THE INVENTION

The present invention relates to a container craning apparatus and, more particularly, to a guide device for stacking containers in multiple tiers.

For craning containers, a spreader S is usually used as a suspender suspended from a container crane. The spreader S, as shown in FIGS. 27 and 28, generally consists of a spreader body 2, which is a frame of almost the same size as a container in the plan view, twist locks 3 and guides 4 located at four corners of the spreader body 2.

In lifting a container 1 by using the spreader S of such a structure, a rope 5 wound on a winch, not shown, mounted on the container crane is fed to lower the spreader S. The lowered spreader S is positioned with the guides 4 and thereafter the twist locks 3 are engaged with fittings at four corners of the container 1. Then, the rope 5 is wound up through a sheave 6 to lift the container 1 to a desired location.

In this type of container lifting or craning, containers are often stacked in two or more tiers in a keeping area. That is, a container 1 suspended by the spreader S is placed on containers already put in the keeping area. This process requires that the container being lifted should be aligned with the lower containers. To improve the efficiency of this positioning work, a container guide device with guides 4 at four corners of the spreader body 2 extending downward, for example, longer than the height of the container, has been proposed (as in Japanese patent application Kokai publication No. 50-88765).

However, the container guide apparatus of the above mentioned construction with downward-extending guides has a drawback. When the spreader S is guided to the side of the container 1, horizontal forces act on the guides and tend to move them laterally, producing large bending moments in the bases of the support members for the guides.

The container can be as high as 2.9 meters; because the spreader must be supported by support members that long, the support members are subjected to large bending moments. To withstand such bending moments requires the support members to have a great mechanical strength and therefore a larger structure.

However, since containers are placed in multiple rows with narrow intervals, it is impossible to obtain a large depth of the cross-section of the support members, so that containers should be constructed of heavy steel plates, increasing the weight of containers. Therefore, the overall weight and the cost of the crane are increased significantly. This proposed guide device is impractical.

SUMMARY OF THE INVENTION

The present invention has been accomplished to solve the aforementioned problems in conventional art. It is an object of the invention to provide a guide apparatus for keeping containers in multiple tiers, in which guides can be raised or lowered by a raising/lowering device installed in the spreader and can be supported at the corners of the spreader, and when the guides are lowered by the raising/lowering device, their spreaded parts project and are secured to the lower ends of the corners of the container gripped by the spreader.

When such a multiple-tier container stacking apparatus is operated to suspend a container, the guides are raised by the raising/lowering device and fixed at the four corners of the spreader body. The guides are fixed to the lower end of the spreader so that their lower expanded portions project from the lower end.

The spreader is then lowered on the container to adjust its position and caused to grip the container with the twist locks. After this, the guides are released from the spreader body and lowered by operating the raising/lowering device until the spreaded parts of the guides reach a position where they project from the lower end of the container held by the spreader, the raising/lowering device is stopped and the guides are secured to the four corners of the lower part of the container.

The spreader holding the container is moved above another container already placed. As the container is lowered, the guides fixed to the four corners of the lower part of the container act as guides for positioning the container with respect to the container already placed. When there is a difference in position between the container held by the spreader and the already-placed container, horizontal forces moving the container in place act on the guides. Such horizontal forces cause the container held by the spreader to move in a horizontal direction. Hence, no bending moments are produced at the base of the spreader that supports vertical support members of guides and the guides themselves, permitting the spreader %o be formed lighter in weight.

BRIEF DESCRIPTION OF THE DRAWINGS

FIG. 4(*a*) through FIG. 4(*c*) are explanatory views, illustrating the operation of the guides, of which:

FIG. 4(*a*) is a side view of the guides secured to the sides of the spreader body;

FIG. 4(*b*) is a side view of the spreader body engaged with the top of a container, and FIG. 4(*c*) is a side view of a container immediately before being placed upon another container;

FIG. 7(*a*) and FIG. 7(*b*) are explanatory views, illustrating the operation of the guide device, of which:

FIG. 7(*a*) illustrates the positioning of the spreader onto the container, and FIG. 7(*b*) illustrates the placing of a container lifted by the spreader on another container;

FIG. 12 is a perspective view, showing a part of the constructions of the guide device according to a fourth embodiment of the invention;

FIG. 13(*a*) and FIG. 13 (*b*) show, in cross-section taken along the line X—X of FIG. 12, the operation of the guide device, of which:

FIG. 13(*a*) is a cross section showing a push fitting in a retracted state, and FIG. 13(*b*) is a cross section showing the push fitting in an expanded state;

DESCRIPTION OF THE PREFERRED EMBODIMENTS

By referring to FIG. 1 through FIG. 26, a description will be entered into the method of stacking containers in multiple tiers using a guide device which is designed to practice the present invention.

Embodiment 1

Figure 1:
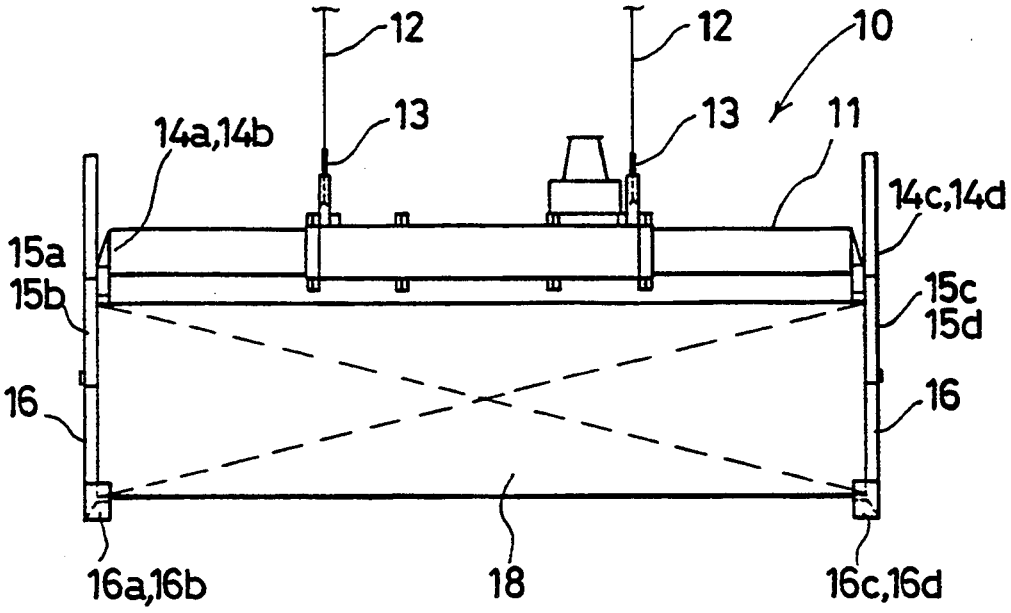
FIG. 1 is a front view of a guide device for craning accroding to a first embodiment of the present invention.
Figure 2:
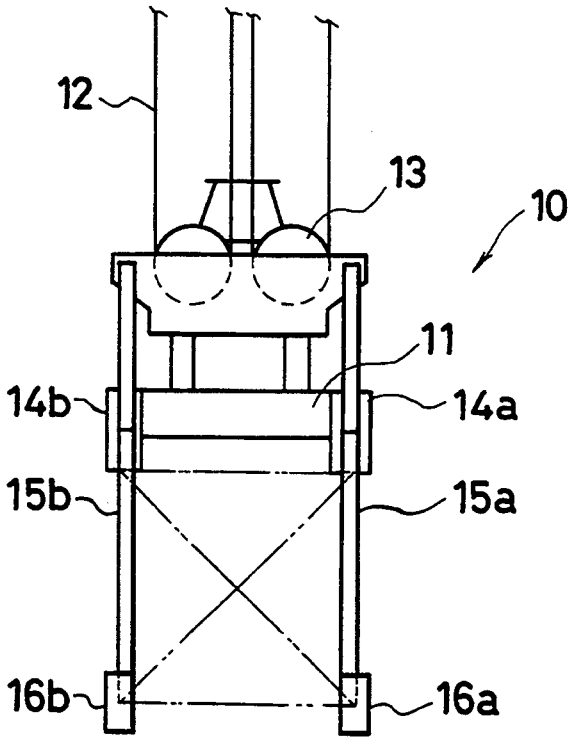
FIG. 2 is a side view of the guide device of FIG. 1.

FIG. 1 is a front view of a spreader 10, a guide device which is designed to practice the present invention. FIG. 2 is a side view of the spreader 10.

A spreader body 11 making up the spreader 10 has sheaves 13, on which a rope 12 from the crane not shown is wound. The spreader body 11 also has guides 16*a*–16*d* at four corners 14*a*–14*d* which are raised or lowered by raising/lowering devices 15*a*–15*d*. These guides 16*a*–16*d*, when raised, are fixed at four corners 14*a*–14*d* of the spreader body 11 by fixing devices not shown.

Figure 3:
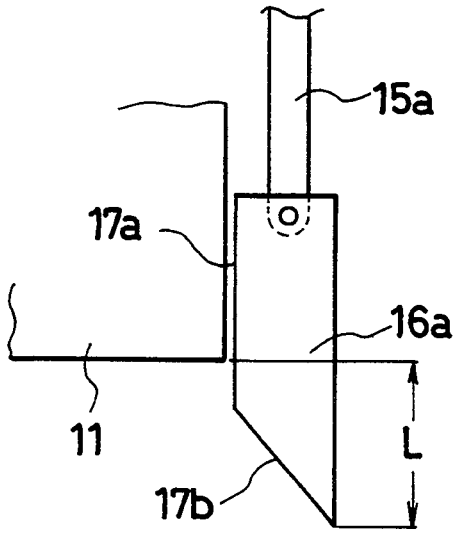
FIG. 3 is an explanatory view, showing guides and spreader body.
Figure 5:
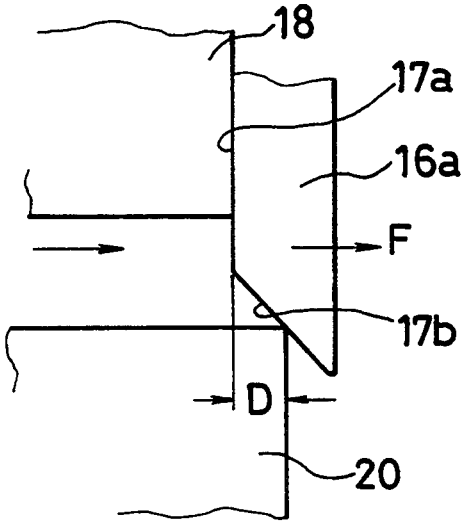
FIG. 5 is an explanatory view, showing an upper container being guided by a lower container through the guide device.

In more detail, the guides 16*a*–16*d*, as shown in FIG. 3 and FIG. 5, each consists of a vertical part 17*a* and a spread part 17*b* (guiding part or slant part). Fixing devices are provided at the corners of the spreader body 11 to hold the guides 16*a*–16*d* immovable when the guides 16*a*–16*d* are positioned at the corners of the spreader body 11.

The fixing devices may be of any type such as a hook type, a magnet type or a fastening type using pin or rope, as long as the guides 16*a*–16*d* can be attached to or detached from the spreader body 11.

Figure 4:
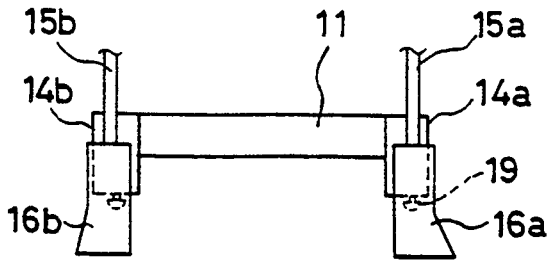
Figure 4:
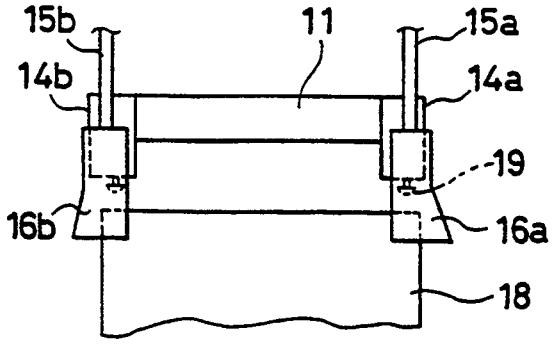
Figure 4:
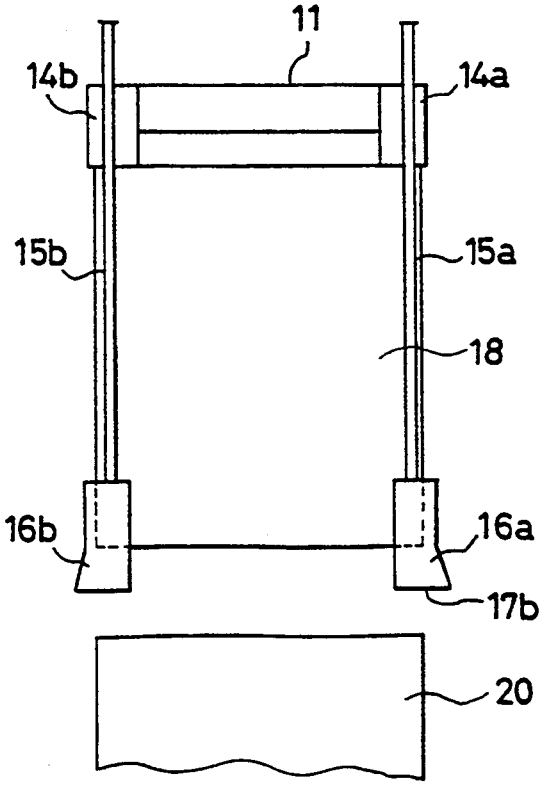

In a method of stacking containers in multiple tiers using a guide device of this construction, first the guides 16*a*–16*d* are raised as shown in FIG. 4(*a*) by operating the raising/lowering devices 15*a*–15*d* and fixed to the four corners 14*a*–14*d* of the spreader body 11 by the fixing devices.

Then, as shown in FIG. 4(*b*), the spreader body 11 is lowered onto a container 18 to be lifted. The guides 16*a*–16*d* serve as guides for aligning the spreader body 11 with the container 18. The twist locks 19 are remotely operated to engage with metal lugs on the top of the container 18.

Next, the raising/lowering devices 15*a*–15*d* are operated again to lower the guides 16*a*–16*d*. As shown in FIG. 4(*c*), they are lowered until the spread parts 17*b* of the guide 16*a* project down from the lower end of the container 18 gripped by the spreader body 11. After this, fixing devices are operated to cause the guides 16*a*–16*d* to grip or fix the corners of the lower part of the container 18. The fixing device, for example, may be the one shown in FIGS. 9 and 10.

Then, as shown in FIG. 4(*c*), the container 18 is moved and suspended over another container 20, which is already placed. As the container 18 is lowered, the container 18 gripped by the spreader body 11 is aligned with the already-placed container 20 by the guiding surfaces of the guided 16*a*–16*d*.

At this time, when there is a difference D in position between the suspended container 18 and the lower container 20, as shown in FIG. 5, the spread part 17*b* of the guide 16*a* contacts the edge of the container 20, so that a horizontal force F is exerted on the guide 16*a*. This force F moves the suspended container 18 in a horizontal direction until the container 18 is aligned with the lower container 20. The guide 16*a* must be fixed to the lower part of the container 18 with sufficient firmness.

Embodiment 2

Figure 6:
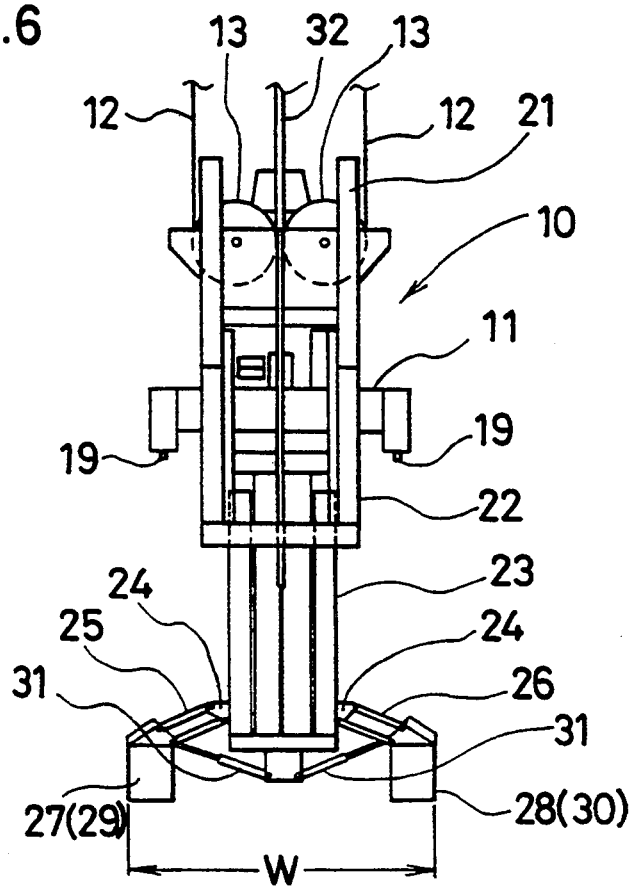
FIG. 6 is a side view of a guide device for craning a container according to a second embodiment of the invention having a raising/lowering device.

FIG. 6 shows a side view of the spreader body 11 of a second embodiment of the invention. The spreader body 11 making up the spreader 10 has sheaves 13 on which ropes 12 from a crane not shown are wound up, and also stationary vertical columns 21 on both longitudinal sides of the spreader body 11.

Each of the fixing columns 21 is provided with an intermediate column 22 and an end column 23 both of which can be vertically expanded or contracted, the intermediate and end columns 22 and 23 constituting an expandable and movable column.

The bottom of the end column 23 is provided with brackets 24 fitted with guides 27–30 through parallel links 25, 26. Between these guides 27 and 28 and between 29 and 30 are provided hydraulic grip cylinders 31 for securing the guides 27–30 to the container 18 or the spreader body 11 by gripping the container 18 with the opposing guides 27–30. By operating the grip cylinders 31, the horizontal interval W can be adjusted. It is also possible to adjust the heights of the guides 27–30 by adjusting the positions of the intermediate column 22 and the end column 23 relative to the stationary column 21 by means of a hydraulic cylinder 32 provided at the center of the side of the spreader 10.

Next, the method of operating the guide of the above construction will be explained.

As shown in FIG. 7(*a*), a container 33 in a specified position is about to be lifted by using the spreader 10.

First, the hydraulic cylinder 32 is operated to raise the end column 23 and the intermediate column 22 toward the stationary column 21, and at the same time the grip cylinder 31 is actuated to grip the corners of the spreader body 11 with the guides 27–30.

At this time, the guides 27, 28 (29, 30) are positioned a distance L below the spreader body 11, with the spread part 17*b* (FIGS. 3 and 5) projecting down, making the spreader 10 as a whole contracted and flat.

Then, the spreader 10 is lowered onto a container 33 by operating a winch not shown, guided by the guides 27–30 and aligned with the container 33, as shown in FIG. 5. When there is a positional difference D between the spreader body 11 and the container 33, a horizontal force F acts upon the guides 28, 30 (16*a* in FIG. 5). Since the guides 27–30 are secured to the corners of the spreader body 11, the horizontal force F causes the suspended spreader 10 to move horizontally until it is automatically aligned with the container 33*a*.

Another horizontal force perpendicular to the above mentioned horizontal force F is transmitted to the spreader body 11 by another face of the L-shaped guide surface of the guides.

After the spreader body 11 is aligned with the container 33, the grip cylinder 31 is operated to release the gripping force between the spreader body 11 and the guides 27–30, after which the hydraulic cylinder 32 is operated to lower the intermediate column 22 and the end column 23 from the stationary column 21 until the guides project down slightly from the container 33. Then, the grip cylinder 31 is operated to grip the bottom part of the container 33 with guides 27–30.

Next, the container 33 is moved and lowered onto another container 33*a* already placed at a specified location. As the container 33 is lowered, the guides 27, 28 (29, 30) contact the top of the container 33*a* and are guided by the top, so that it is aligned with the already-placed container 33*a*. If there is a positional difference D between the container 33 and the container 33*a*, horizontal forces act on the guides 27, 28 (29,30), as shown in FIG. 5. Because the guides 27, 28 (29, 30) securely hold the bottom of the container 33, the horizontal forces F cause the container 33 to move horizontally to align the container 33 with the container 33*a*.

After the container 33 is placed on the container 33*a*, the grip cylinder 31 is operated to release the guides 27, 28 (29, 30) and at the same time the twist locks 19 are remotely operated to become released. The hydraulic cylinder 32 is also operated to raise the intermediate column 22 and the end column 23 to the position shown in FIG. 7(*a*).

Embodiment 3

Figure 8:
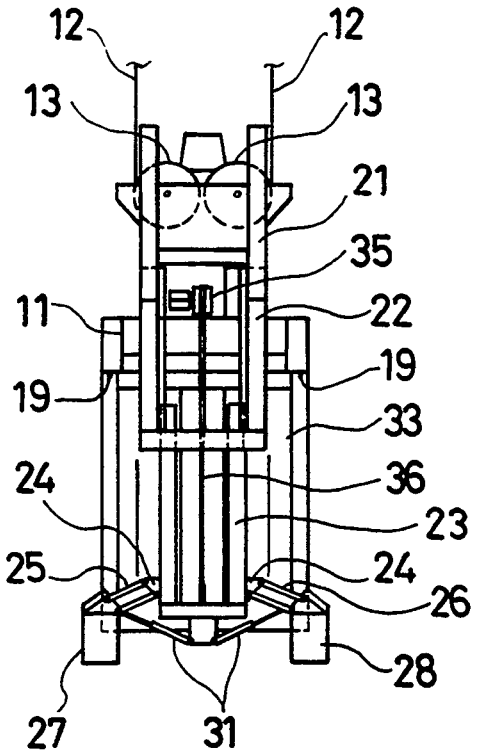
FIG. 8 is a side view of a guide device of a third embodiment of the invention having another type of raising/lowering device.

FIG. 8 shows a third embodiment of the invention. The spreader 11 is provided with a winch 35 as a raising/lowering device, on which is wound a wire rope 36 whose one end is connected to the end column 23. This device is operated in the same way as the previous embodiment.

Figure 9:
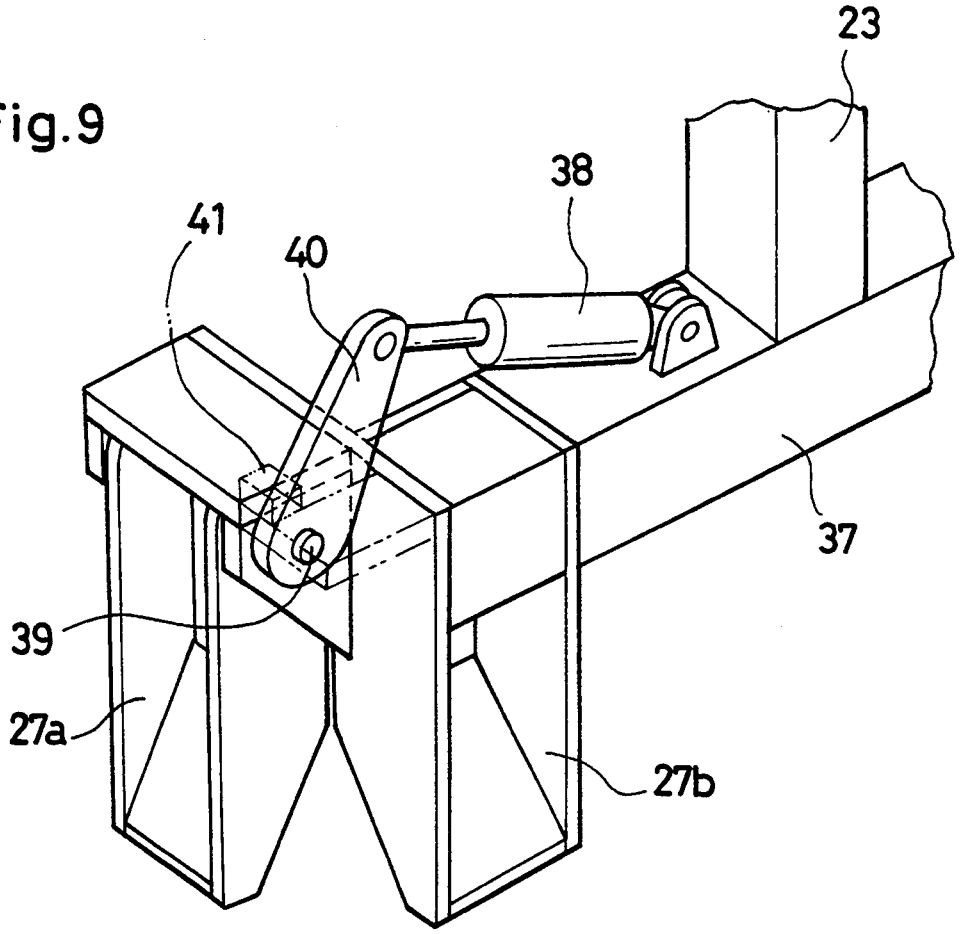
FIG. 9 is a perspective view, showing a part of the guides as a fixing device having a gripping function.
Figure 10:
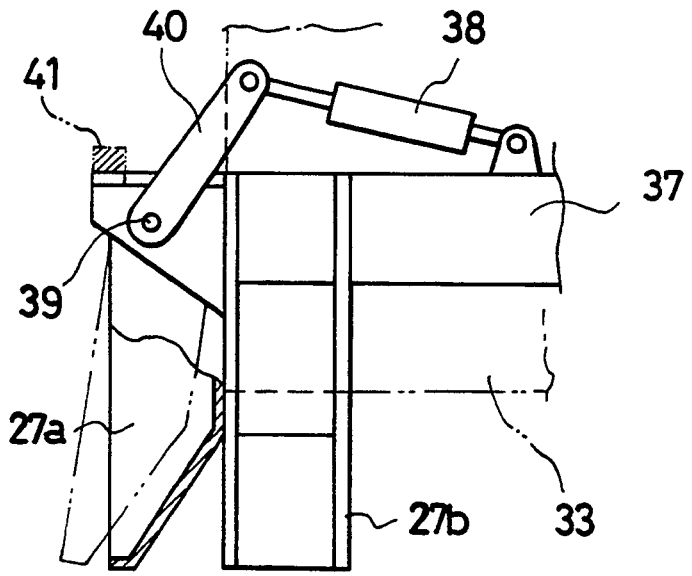
FIG. 10 is an explanatory view, illustrating the operation of the guides of FIG. 9.

FIG. 9 and FIG. 10 show another example of a fixing device or gripping mechanism using the guides 27–30. A lateral beam 37 constituting the end column 23 has swingable and movable guide 27*a* and a stationary guide 27*b*, arranged perpendicular to each other. The movable guide 27*a* is rotated about a hinge 39 by a grip cylinder 38 to increase the range in which the spreader 10 is guided by the top corners of the container. Denoted at 40 is a link to rotate the movable guide 27*a*, and 41 is a stopper to define the swing range of the link 40.

Figure 11:
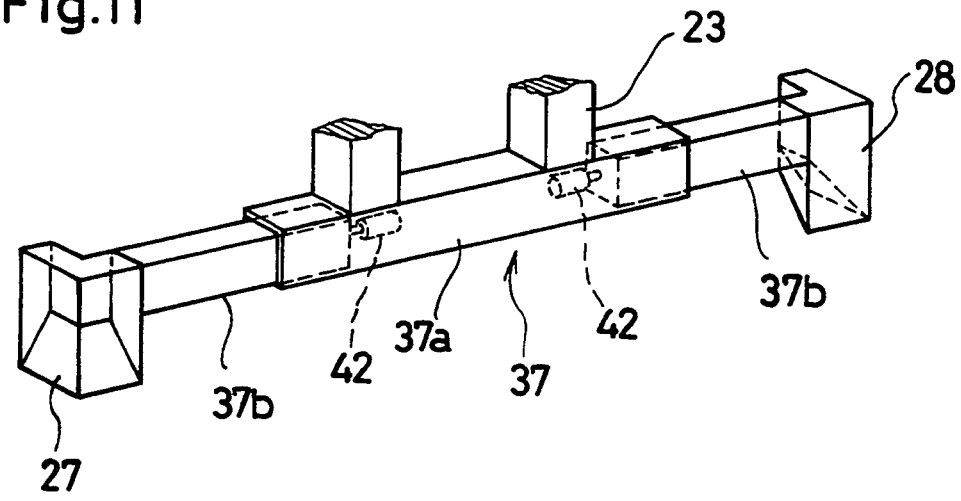
FIG. 11 is a perspective view of the guides with a gripping function of a type which expands or contracts the lateral beam.

FIG. 11 shows a further example of the gripping mechanism using the guides 27, 28 (29, 30). The lateral beam 37 of the end column 23 is formed of a stationary beam 37*a* and movable beams 37*b* in an expandable manner. The movable beams 37*b* are attached at the ends with the guides 27, 28 (29, 30). The grip cylinders 42 mounted in the stationary beam 37*a* are operated to move horizontally the movable beams 37*b* and guides 27, 28 at the ends of the movable beams 37*b*, thereby gripping the spreader body 11 or the container 33.

Embodiment 4

FIG. 12 and FIGS. 13(*a*) and 13(*b*) show a fourth embodiment. FIG. 12 is a view, showing a part of the guide having a gripping mechanism and a raising/lowering means, FIG. 13(*a*) and FIG. 13(*b*) are cross-sectional views taken along the line X—X in FIG. 12.

In FIG. 13(*a*), the guide 27 is mounted with a tube 43, in which are assembled a hydraulic cylinder 44 and a pressing metal member 45 that is attached to the end of the cylinder 44 and slides along the inner surface of the tube 43. When the guide 27 is moving up or down, the hydraulic cylinder 44 contracts as shown in FIG. 13(*a*), with the pressing metal member 45 retracted inwardly at least from the inner side of the guide 27.

When the guides 27, 28 are at the upper or lower end position, the cylinder 44 is extended to cause the pressing metal member 45 to press the container 38 or the spreader body 11, as shown in FIG. 13(*b*). The horizontal force F for horizontally moving the upper container 33 and aligning it with the lower container is transmitted to the spreader body 11 or the container 33 through the guides 27–30 that hold the corners of the container, as is the case with the preceding embodiment.

As shown in these examples, there are many methods of gripping the container 33 or the spreader body 11 with the guides 27–30, in which the guide body 11 itself may be movable or a part attached to the guides 27–30 may be movable. Any structure can be adopted as long as it has a function of temporarily fixing the guides 27–30 to the side of the spreader 11 or to the bottom corners of the lifted container.

Although as means for raising/lowering the pairs of guides 27–30, a method illustrated in FIGS. 6 to 8 which uses the stationary column 21 and the movable columns 22, 23 has been described, other methods are adoptable. As described above referring to FIGS. 6 to 8, for the alignment between the guide and the container or between the containers, the horizontal forces are directly transmitted to the container 33 through the gripping forces or fixing forces between the guides 27–30 and the spreader body 11 or between the guides between the guide 27–30 and the container 33, so that the columns 21, 22, 23 are not necessarily strong. Hence, a raising/lowering means such as a cylinder or a rope (not shown) of a winch may be provided in the lateral beam 37 as shown in FIG. 12.

Embodiment 5

Figure 14:
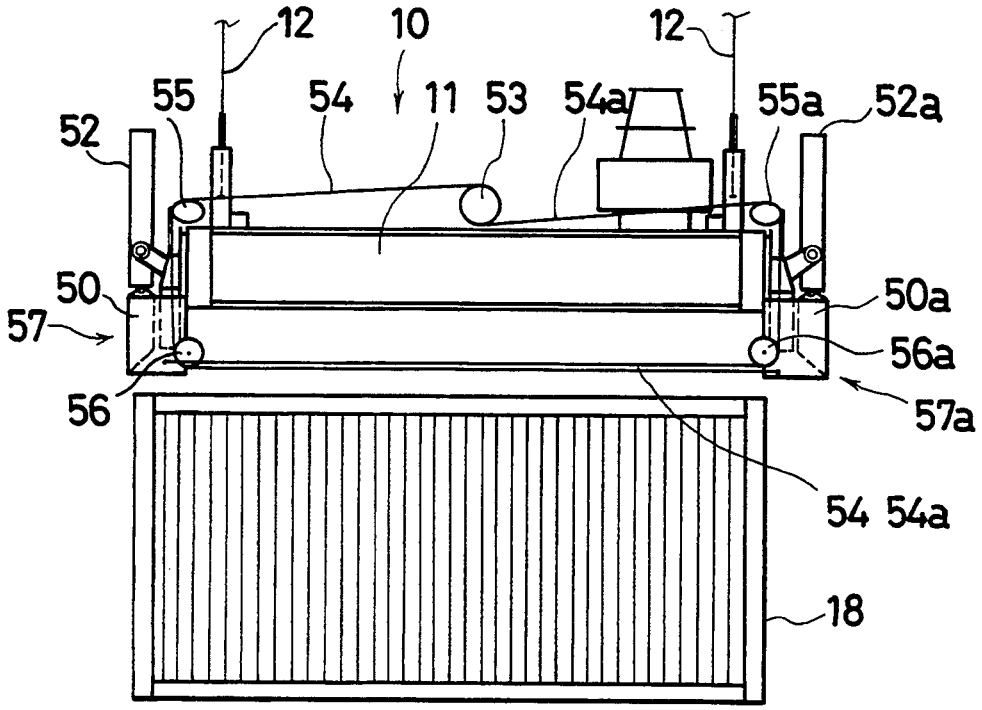
FIG. 14 is a front view of a guide device of a fifth embodiment of the invention.
Figure 15:
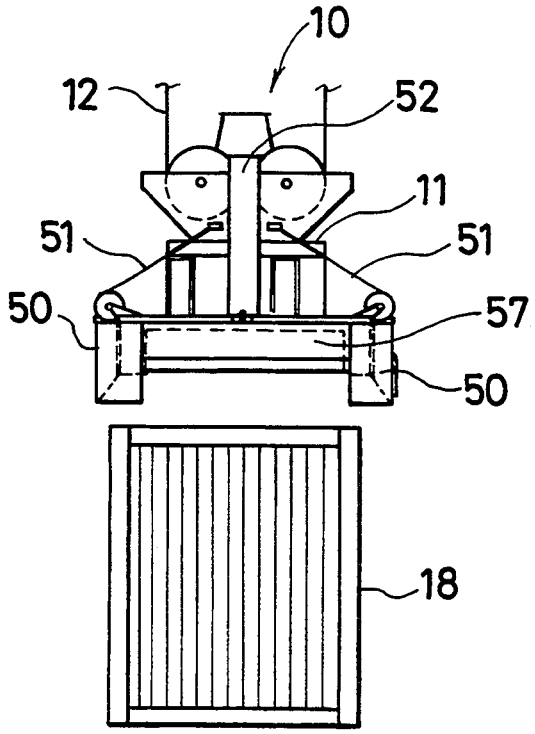
FIG. 15 is a side view of the device of FIG. 14.

FIG. 14 and FIG. 15 show a fifth embodiment of the invention. In this embodiment the left and right guides 50, 50*a* mounted vertically movably on sides of the spreader body 11 are pulled by wires 54, 54*a*, so that the raising/lowering device is not applied with a large force while the container is being guided.

The fifth embodiment has long hydraulic cylinders 52, 52*a* mounted on both sides of the spreader body 11, with the central parts of guide frames 57, 57*a* so connected to the cylinder rods that the guide frames can be moved up or down relative to the spreader body 11. The guide frames 57, 57*a* have at their both ends guides 50, 50*a* having an L-shaped cross section, which engage with the corners of the container 18.

A winch 53 is provided at an upper part of the spreader body 11. Two wires 54, 54*a* connected to the winch 53 are drawn out to both sides of the spreader body 11 and connected through a plurality of sheaves 55, 55*a*, 56, 56*a* to the guide frames 57, 57*a* that are on the sides opposite to where they are drawn out.

To grip the container 18 by this spreader 10, the winch 53 is wound up and the hydraulic cylinders 52, 52*a* are contracted to position the guide frames 57, 57*a* at both sides of the spreader body 11, with the guides 50, 50*a* projecting down from the spreader body 11. In this state, the guide frames 57, 57*a* are secured to the sides of the spreader body 11.

Then, the spreader body 11 is moved over the container 18 to be gripped, and is lowered while being guided by the guides 50, 50*a* until they engage with the top of the container 18. And the twist locks proovided on the underside of the spreader body 11 are engaged with the fittings provided on the top surface of the container 18.

In engaging the spreader 10 with the container 18, the spread parts 17*b* of some of the guides 50, 50*a* (FIG. 3) make contact with the top corners of the container 18, causing the spreader 10 to move horizontally and to be aligned with the container 18 accurately.

At this time, since the guide frames 57, 57*a* are pulled toward each other by the wires 54, 54*a*, horizontal forces F that tend to move the spreader 10 in a longitudinal direction of the container 18 generate tensions in the wires 54, 54*a* and are transmitted to the frames 57, 57*a* on the opposite side. Forces which act in the direction of the width of the container 18 on the guides 50, 50*a* provided to both ends of the frame 57 or 57*a*, act as axial forces on the frames 57, 57*a* to which the guides 50, 50*a* are mounted, causing the spreader 10 to move in the direction of force.

When the spreader body 11 is placed directly on the container 18, the twist locks provided on the underside of the spreader body 11 are engaged with the fittings provided on the top surface of the container 18 to connect the spreader body 11 with the container 18.

The spreader body 11 together with the container 18 is then moved over another container already placed in a predetermined position.

Next, the frames 57, 57*a* with the guides 50, 50*a* secured to their ends are used as guide members for stacking containers. At this time, the brake of the winch 53 is released to feed out the wires 54, 54*a* and the hydraulic cylinders 52, 52*a* are extended to lower the guide frames 57, 57*a* to the bottom part of the container 18. Then, with the guide frames 57, 57*a* positioned at the bottom of the container 18 and with the guides 50, 50*a* projecting slightly from the bottom of the container 18, the wires 54, 54*a* are wound up on the winch 53 to fix them.

When the container 18 is lowered onto the already-installed container, the guides 50, 50*a* projecting down from the bottom four corners of the container 18 contact the upper corners of the lower container, generating forces causing the container 18 to move in a horizontal direction. As the container 18 is moved horizontally, the forces acting on the guides 50, 50*a* produce tensions in the wires 54, 54*a*.

Variation of Embodiment 5

Figure 16:
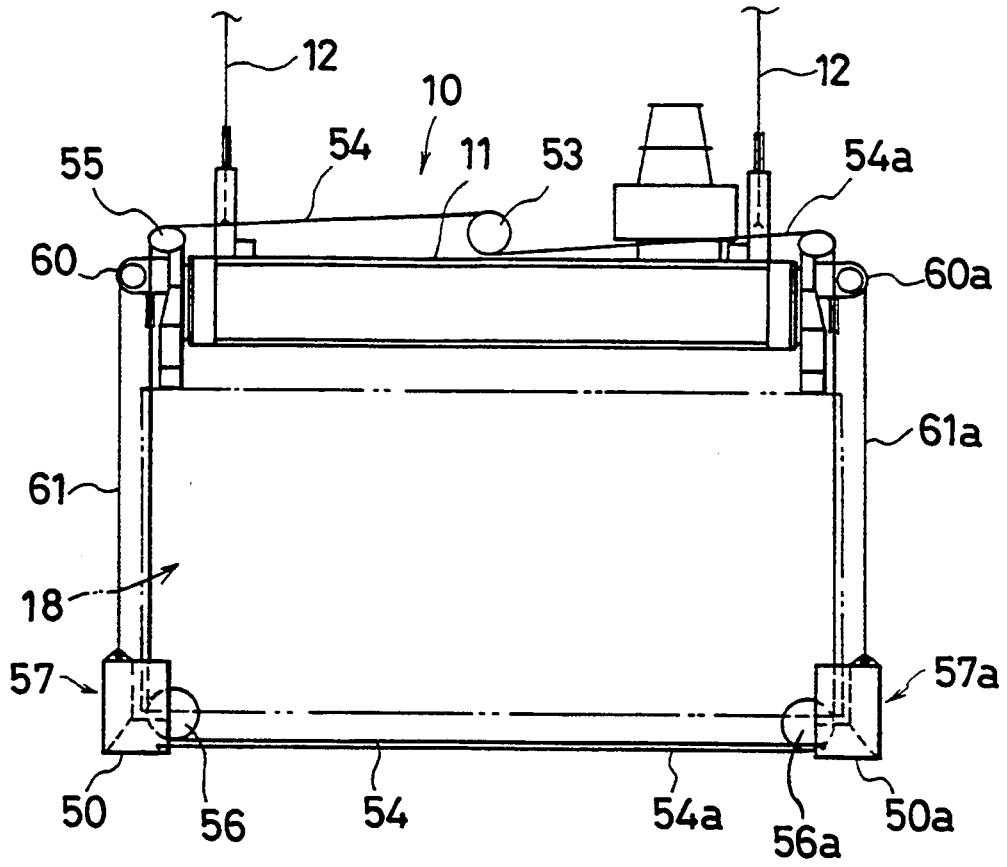
FIG. 16 is a front view of a variation of the fifth embodiment.
Figure 17:
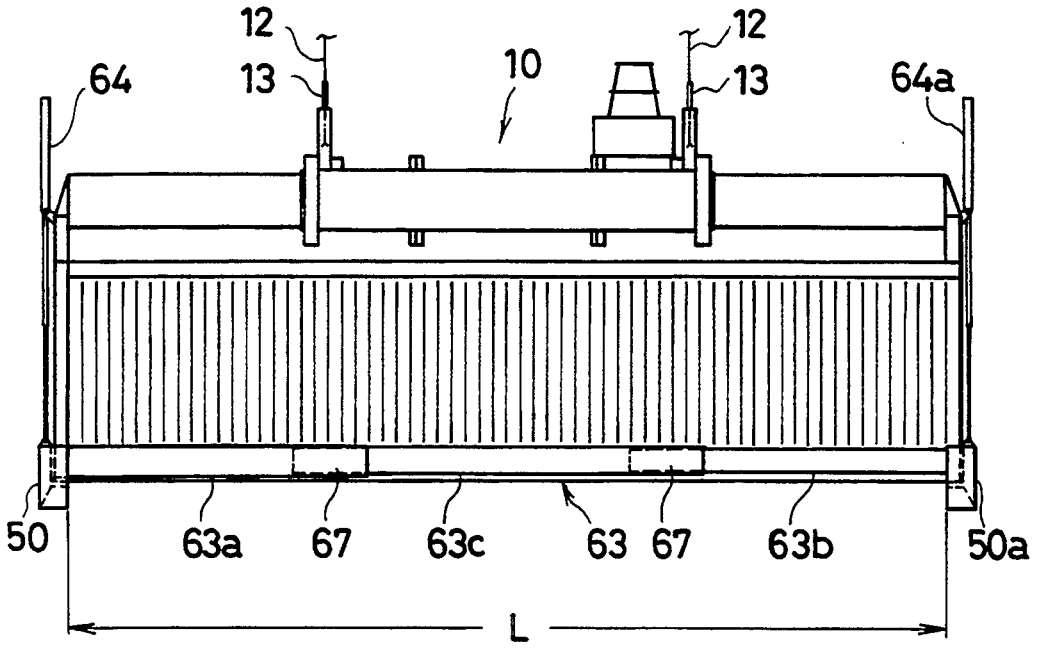
FIG. 17 is a front view of a guide device of a sixth embodiment.
Figure 18:
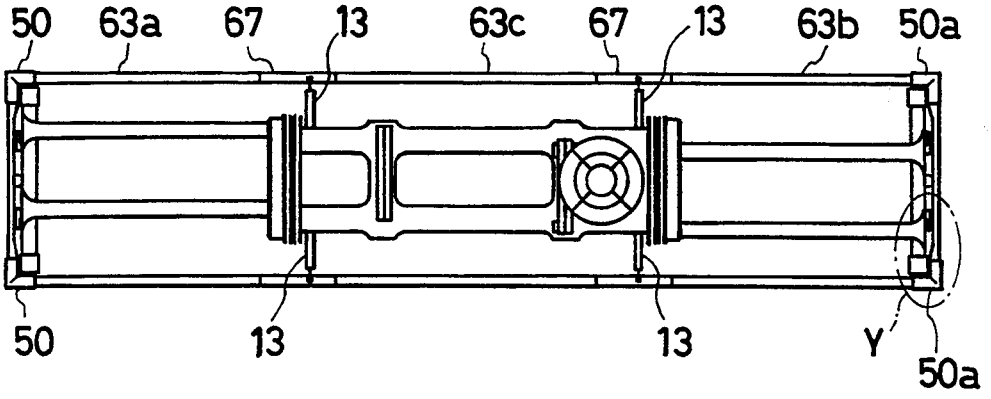
FIG. 18 is a plan view of the device of FIG. 17.

FIG. 16 shows a variation of the fifth embodiment shown in FIGS. 14 and 15. Though the fifth embodiment has employed the hydraulic cylinders 52, 52*a* on both sides of the spreader body 11 as means to raise or lower the frames 57, 57*a*, this variation uses winches 60, 60*a* on both sides of the spreader body 11, from which wires 61, 61*a* are drawn out to suspend the frames 57, 57*a*.

In this example, too, means for pulling the two frames 57, 57*a* toward each other are two wires 54, 54*a*. When aligning the container 18 gripped by the spreader 10 with another container or when stacking the container 18 on a container already placed in a specified location, the horizontal forces F produced in the frames 57, 57*a* are born by wires 54, 54*a* and the frames 57, 57*a*, as in the case of the fifth embodiment shown in FIG. 14 and 15.

FIG. 17 through FIG. 20 show a sixth embodiment. This embodiment uses a guide frame 63 which is vertically moved by hydraulic cylinders 64, 64*a*.

The guide frame 63 consists of a first frame member 63*a* which is U-shaped in plan view, a second frame member 63*b* similar to the first one, and an intermediate member 63*c* connecting the two frame members 63*a*, 63*b* together. The guide frame 63 is supported vertically movably on each side of the spreader body 11 by the hydraulic cylinders 64, 64*a* provided on the sides of the spreader body 11. These frame members 63*a*, 63*b*, 63*c* are so connected altogether by stoppers 67 that they can be remotely controlled and pulled and secured altogether or released. The frame members 63*a* and 63*b* are provided with guides 50, 50*a*.

Figure 19:
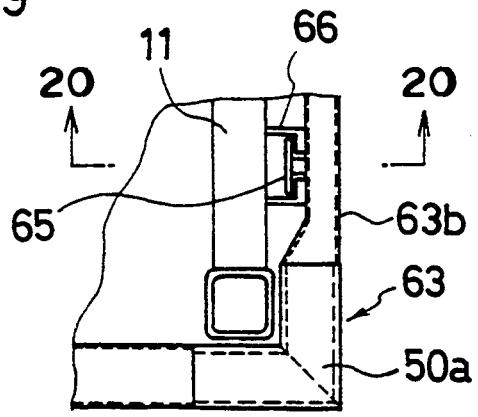
FIG. 19 is an enlarged plan view of a part Y in FIG. 18.
Figure 20:
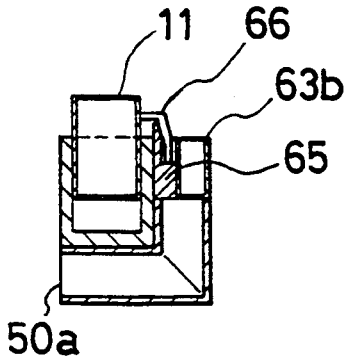
FIG. 20 is a vertical cross section of a part of FIG. 19.

As shown in FIGS. 19 and 20, the guide frame 63 has an engagement metal member 65 installed inside, which engages with a pocket 66 formed in the side of the spreader body 11, thereby automatically positioning itself.

In this embodiment, to grip the container, the guide frame 63 is fixed to the spreader body 11. To place the gripped container on an already installed container, the hydraulic cylinders 64, 64*a* are operated to lower the guide frame 63 along the sides of the container fixed to the spreader body 11 by the twist locks until the guide frame 63 is positioned at the bottom of the container where it works as a guide for the alignment of the two containers.

When the guides 50, 50*a* contact another container, a tensile force is generated in the guide frame 63 causing the suspended container to be aligned with the lower container. The stopper 67 pulls and secures the frame members 63*a*, 63*b* to the other member 63*c*, thereby securing the guides 50, 50*a* to the sides of the spreader body 11 or the container. This securing force is produced by the hydraulic cylinder or electric motor incorporated in the stopper 67.

Embodiment 7

FIG. 21 through FIG. 26 show an example of methods of controlling the guide device for craning a container.

To stack containers in multiple tiers, it is necessary to align a container gripped by a spreader with another container placed already. Handling containers by using a guide device having vertically movable guides requires many operations such as lifting or lowering the spreader, engaging or disengaging twist locks, moving a trolley, operating a crane, and further raising, lowering and positioning the guide frame fitted with guides. Furthermore, the container heights are classified into three, making the handling of containers further complicated and the work efficiency low and increasing the fatigue of the operator. The guide device control method of the invention solves these problems.

Figure 21:
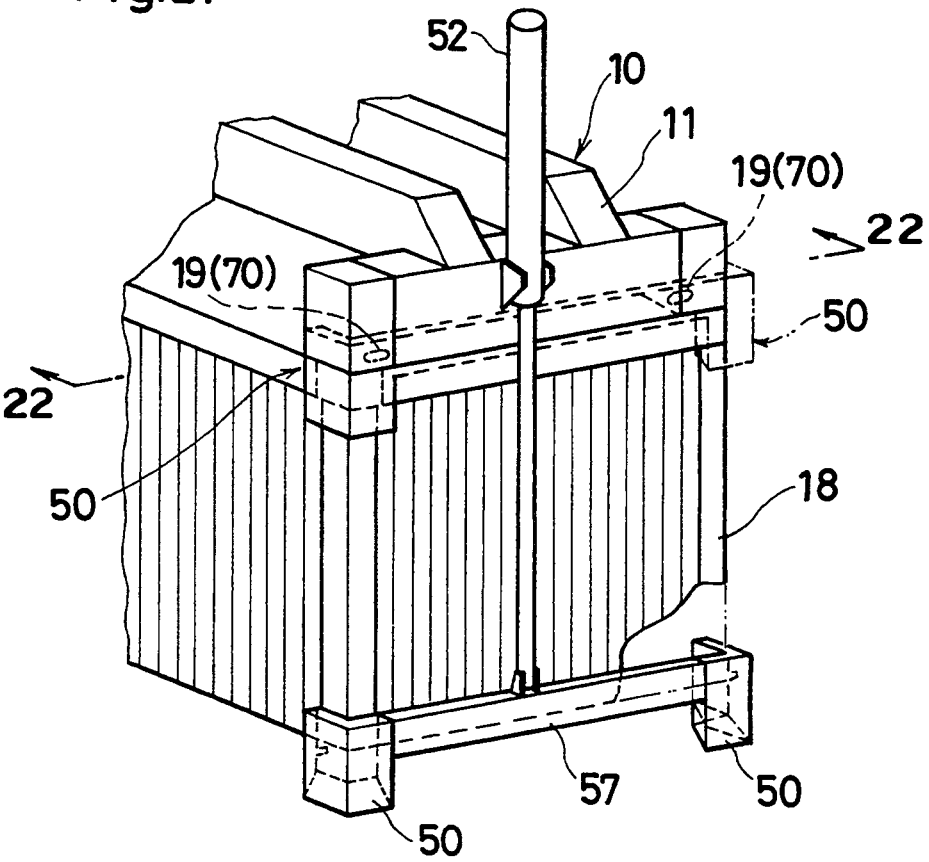
FIG. 21 is a perspective view of a guide device according to a seventh embodiment of the invention.
Figure 22:
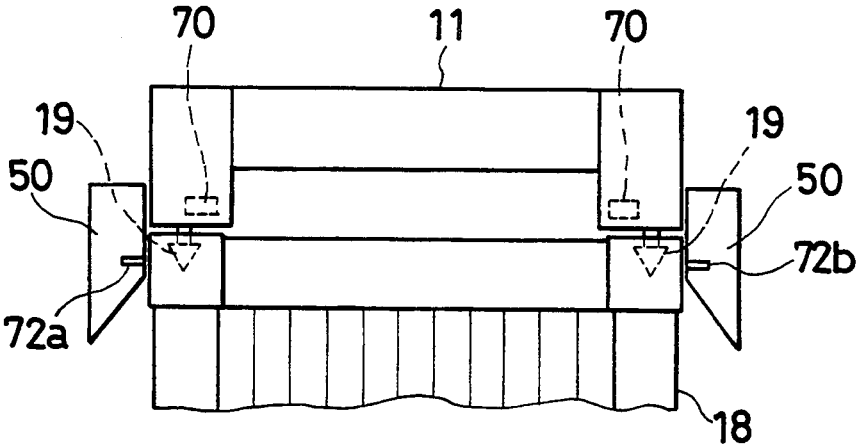
FIG. 22 is a view, showing position sensors provided to the guides.
Figure 23:
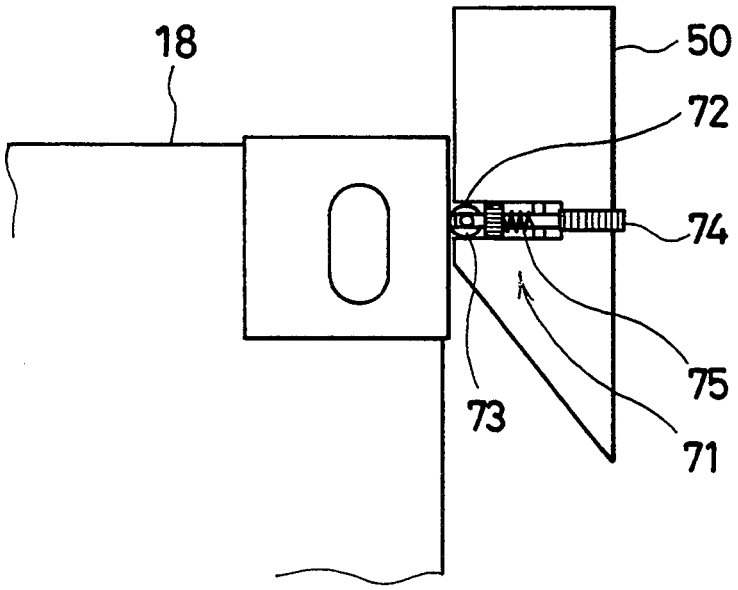
FIG. 23 is a cross section of one of the position sensors.

FIG. 21 is a perspective view of a part of the spreader 10 that holds the container 18 by twist locks 19. On the sides of the spreader body 11 that makes up the spreader 10, frames 57, 57*a* are supported vertically movably by hydraulic cylinders 52, 52*a*, with guides 50, 50*a* so attached to the ends of each frame as to be arranged on the four corners of the container 18. The spreader body 11 has a first detector 70, which detects the engagement and disengagement of the twist locks 19 and generate engagement signal $V_1$ and disengagement signal $V_2$. The guides 50, 50*a* have a second detector 71, as shown in FIG. 23.

Figure 24:
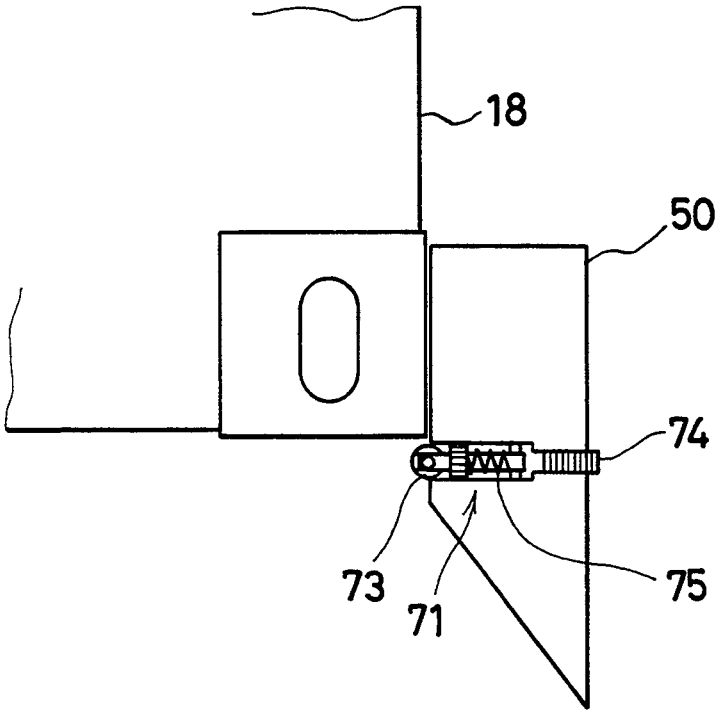
FIG. 24 is a cross section, illustrating the operation of the position sensor.

The guides 50, 50*a* each have a vertical part and a spread portion. The second detector 71 is located inside a lower end part of the vertical part. As shown in FIG. 23, the vertical part is formed with a hole 72 extending perpendicularly to the inner surface thereof. A detection rod 74 with a roller at its end is installed in the hole 72 and can protrude from this hole by a spring 75. When this second detector 71 detects the presence of the container 18 inside the guides 50, 50*a*, it generates a container confirmation signal $V_3$. When, as shown in FIG. 24, the second detector 71 cannot detect the container, i t interrupts the container confirmation signal $V_3$.

The second detector 71 may comprise a detection rod and a limit switch in combination as above. Alternative to this, it may be provided in anyone of various other manners: For example, it may be devised to provide a projector of a photocell on the side of a hole 72*a* and a photosensor of the photocell on the side of a hole 72*b*, and make an arrangement such that while the container confirmation signal $V_3$ is issued when the light beam projected by the projector is interrupted, the signal $V_3$ is interrupted when the light beam from the projector is received by the photosensor.

Figure 25:
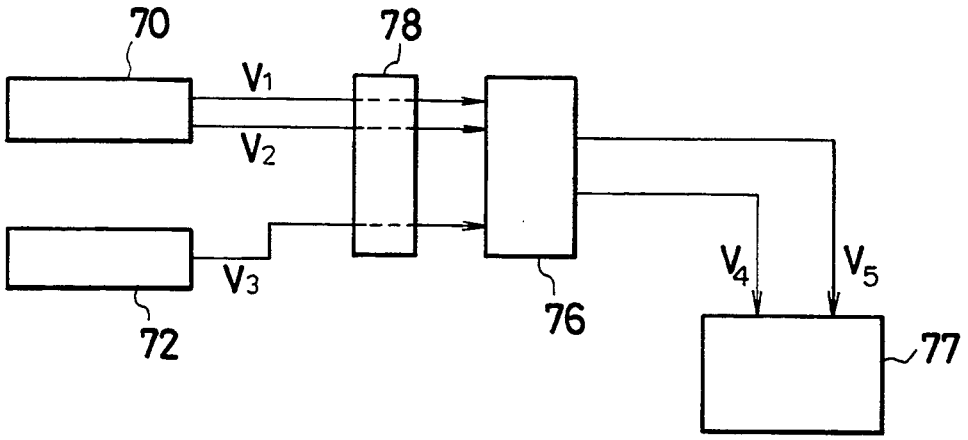
FIG. 25 is a signal system diagram.

These signals $V_1$–$V_3$ are fed to a controller 76 installed in the oprator's cabin of the crane, as shown in FIG. 25. From these signals, the controller 76 generates control signals $V_4$, $V_5$ for the raising/lowering device 77 of the guides 50, 50*a*, more specifically a lowering command signal $V_4$ and a raising command signal $V_5$. The numeral 78 denotes a start switch provided to the controller 76.

Figure 26:
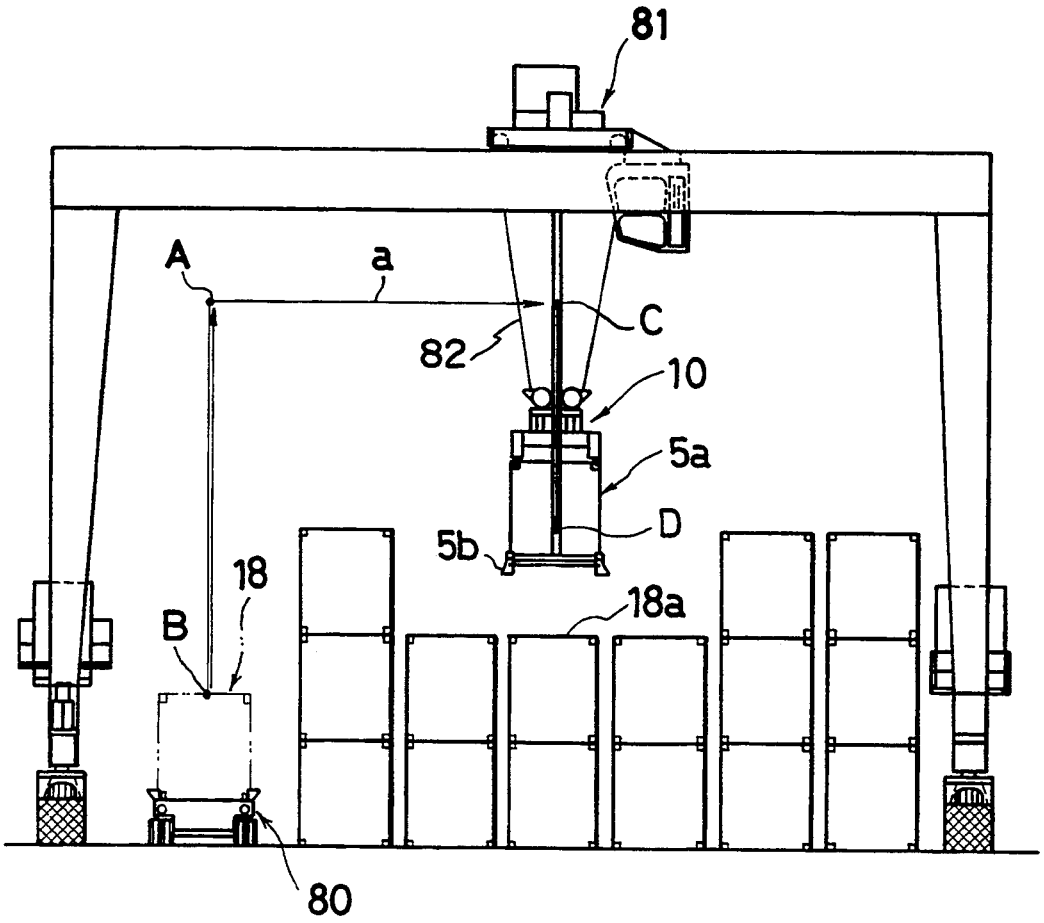
FIG. 26 is an explanatory view, illustrating how the crane is operated.
Figure 27:
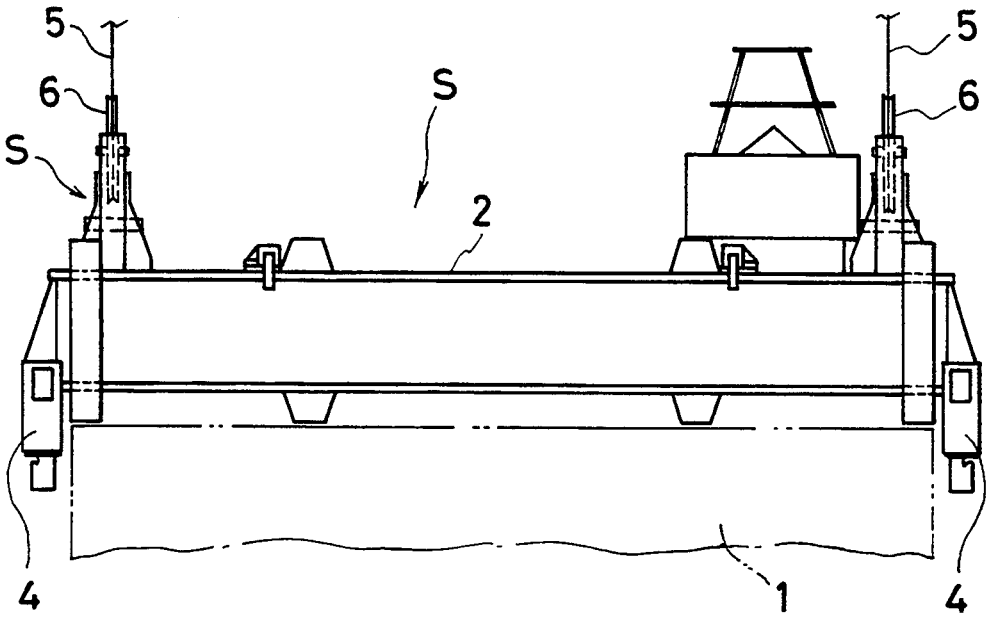
Fig.27 PRIOR ART
FIG. 27 is a front view of a conventional guide device.
Figure 28:
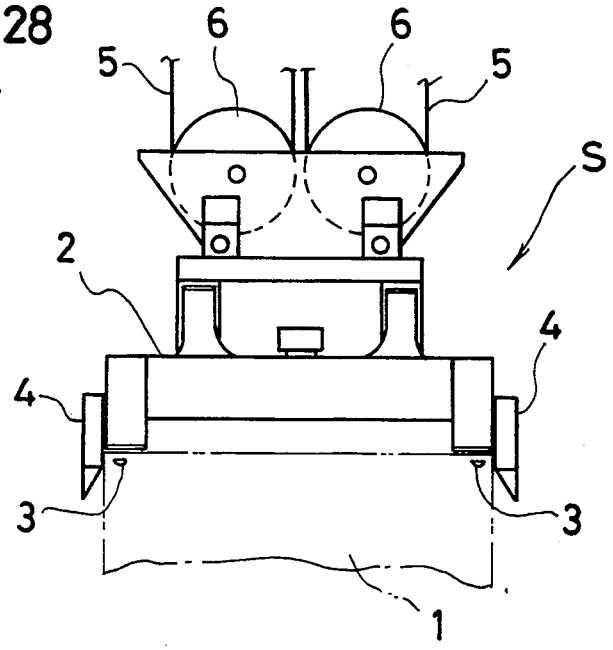
Fig.28 PRIOR ART
FIG. 28 is a side view of FIG. 27.

In this structure, a description wi 11 be given for the procedure of placing the container 18 which has been carried by a trailer chassis 80, and of stacking it onto an already-placed container 18*a*, as shown in FIG. 26.

First, the trolley 81 is moved to carry the spreader 10 to a point A, where a suspension wire 82 wound on the winding device is fed out to lower the spreader 10 onto the container 18. At this time the start switch 78 of the controller 76 is on, but since the second detector 71 does not detect the container 18 on the inner side, the container confirmation signal $V_3$ is not generated, so that the raising/lowering device 77 keeps the guides 50, 50*a* on the top four corners of the spreader body 11 in a pull-up state. The guides 50, 50*a* can align the spreader 10 with the container 18.

When the container 18 is gripped by the twist locks 19, the second detector 71 sends the container confirmation signal $V_3$ to the control let 76 and at the same time the first detector 70 feeds the engagement signal $V_1$ to the controller 76, which then sends the guide lowering command signal $V_4$ to the raising/lowering device, causing the guides 50, 50*a* to lower.

When the guides 50, 50*a* move further downward, their spread parts (17*b* in FIG. 3) project from the bottom of the container 18. When the second detector 71 passes the bottom of the container 18, it stops sending the container confirmation signal $V_3$, stopping the guides 50, 50*a*. Then, the container 18 and the guides 50, 50*a* are fastened together by a fixing device not shown.

Such operations as lowering, stopping and fixing of the guides 50, 50*a* are done while the container 18 is lifted from point B and then lowered onto the already-placed container 18*a* at point C. As the spreader 10 is lowered onto the container 18*a*, the suspended container 18 is guided by the guides 50, 50*a* that project from the bottom of the container 18 and aligned with the container 18*a*. Then, when the twist locks 19 are released, the disengagement signal $V_2$ is fed to the controller 76, which then sends the raising command signal $V_5$ to the raising/lowering device 77 to lift the guides 50, 50*a*.

The guide device of the present invention is suited for stacking containers in multiple tiers. This device is characterized in that the guides are so provided to the spreader body that they are vertically movable by the raising/lowering device and can be secured to the four corners of the spreader body, and that these guides are moved to the lower corners of the container gripped by the spreader in such a manner that the spread part of the guides project down from the bottom of the container.

Therefore, when the container is held by the spreader body and the guides are positioned at the bottom of the container and fixed to or engaged with the container by a gripping means or pressing means with their spread parts protruding down from the bottom of the container, the guides act as if they were securely mounted to the bottom of the container. Hence, the positional difference, if any, between the upper and lower containers can easily be eliminated by the guides engaging with the top edges of the lower container to guide the upper container and align it with the lower one.

Unlike conventional devices in which a spreader body bears reaction forces acting on the guides, according to the present invention the reaction forces are born by the container to or with which the guides are secured or engaged.

Therefore, when the upper container is being aligned with the lower container during the work of stacking containers, the forces acting on the guides do not act either on the spreader body or on the vertical columns of the guides as bending moments. As a result of this, the guides need only have an irreducible minimum strength, which in turn reduces the weight of the spreader, contributing to a reduction in the overall weight and the building cost of the crane.

What is claimed is:

1. A guide device for lifting and transporting a container, said device comprising:

a spreader body;

two pairs of guides arranged on both longitudinal sides of the spreader body, each guide having at least one inclined surface which makes contact with an edge of the container;

a raising/lowering device for raising and lowering the guides; and a member for securing the guides to the container arranged on the spreader body;

wherein the guides project slightly from the bottom of the spreader body, and wherein the guides are movable to be lowered and stopped at a lower part of the container such that the guides project slightly from the bottom of the container, and wherein the guides are movable to move to and from the sides of the container.

2. A guide device for craning a container as claimed in claim 1, wherein the raising/lowering device comprises a vertical stationary column mounted to the spreader body, and at least one movable column which is vertically movable along the stationary column, and wherein a horizontal beam is mounted to an end of a lowermost column, with ends of said horizontal beam fitted with one of said guides that each have a guiding surface for engagement with a corner of the container, the guides being provided with lock devices that project into the sides of the container to lock the guides to the container.

3. A guide device for craning a container as claimed in claim 1, wherein the raising/lowering device comprises a vertical stationary column mounted on the sides of the spreader body and at least one movable column movable vertically along the stationary column, and a horizontal beam disposed on an end of the lowermost column with one of said guides at each end thereof for guiding the spreader body in a longitudinal direction and a width direction, said one of said guides including a swingable portion for guiding the spreader in the width direction of the container, and a drive device for driving the swingable guide.

4. A guide device for lifting and transporting a container, said device comprising:

a spreader body;

a raising/lowering device coupled to said spreader body for raising and lowering a container, said raising/lowering device comprising a vertical stationary column mounted to the spreader body and at least one movable column vertically movable along the stationary column, with said at least one movable column being moved with respect to said stationary column by a drive means;

two pairs of guides arranged on both longitudinal sides of the raising/lowering device, each guide having at least one inclined surface which makes contact with an edge of the container;

a member for securing the guides to the sides of the container arranged on both sides of the raising/-lowering device, wherein the guides project slightly from the raising/-lowering device, and wherein the guides are movable to and from the sides of the container, and wherein the spreader body is movable to move the container.

5. A guide device as recited in claim 4, wherein said drive means for said raising/lowering device comprises a hydraulic cylinder which moves said movable columns with respect to said stationary columns.

6. A guide device as recited in claim 4, wherein said drive means for said raising/lowering device comprises a winch which moves said at least one movable column with respect to said stationary columns.

7. A guide device as recited in claim 4 wherein said pairs of guides are movably attached to said at least one movable column, and are positionable through the use of positioning drive means.

8. A guide device as recited in claim 4, wherein said at least one inclined surface is for engaging an outer surface of said container.

9. A guide device as recited in claim 4, wherein the raising/lowering device includes a horizontal beam mounted on an end of a lowermost movable column, said horizontal beam having a stationary portion and a movable portion, with one of said guides mounted on an outer end of the movable portion, wherein a distance between the guides can be adjusted through horizontal movement of said movable portion.

10. A guide device as recited in claim 4, wherein at least one of said guides is swingably disposed on one of said columns, and wherein positioning drive means is coupled to said one of said guides and said one of said columns, said one of said guides being moved by said positioning drive means to engage said container.

11. A guides device as recited in claim 4, wherein at least one of said guides comprises a sensor means for detecting a presence and an absence of said container.

* * * * *

UNITED STATES PATENT AND TRADEMARK OFFICE

CERTIFICATE OF CORRECTION

PATENT NO. : 5,354,112

DATED : October 11, 1994

INVENTOR(S) : Shinji HARA et al

It is certified that error appears in the above-identified patent and that said Letters Patent is hereby corrected as shown below:

On the Title Page, Item [54], change "SIFTING" to -- LIFTING --.

On the Title Page, Item [30], last line, change "Oct. 23, 1992" to -- Oct. 28, 1992 --.

On the Title Page, Item [30], last line, change "4-290322" to -- 4-290332 --.

Signed and Sealed this

Fourteenth Day of February, 1995

*Attest:*

*Attesting Officer*

BRUCE LEHMAN

*Commissioner of Patents and Trademarks*